United States Patent [19]

Simms

[11] 4,400,047

[45] Aug. 23, 1983

[54] DISTRIBUTION MODULE FOR MULTI-WIRE GROUP

[76] Inventor: Alfred P. Simms, 1443 Maple St., Kent, Wash. 98031

[21] Appl. No.: 283,202

[22] Filed: Jul. 14, 1981

[51] Int. Cl.[3] ..... H01R 23/02

[52] U.S. Cl. ..... 339/18 R; 339/198 R; 339/198 K; 339/210 M

[58] Field of Search ..... 339/18 R, 17 C, 18 P, 339/198 R, 198 C, 198 K, 210 R, 210 M; 179/1 PC, 98

[56] References Cited

U.S. PATENT DOCUMENTS

| | | | |
|---|---|---|---|
| 3,054,024 | 3/1959 | Van Dillen et al. | 317/101 |
| 3,152,219 | 10/1964 | Murray et al. | 339/198 R |
| 3,239,796 | 3/1966 | Buchanan et al. | 339/97 |
| 3,708,779 | 1/1973 | Enright et al. | 339/99 R |
| 3,772,635 | 11/1973 | Frey et al. | 339/99 R |
| 3,778,750 | 12/1973 | Caveney et al. | 339/97 R |
| 3,836,942 | 9/1974 | Knickerbocker | 339/97 R |
| 3,877,771 | 4/1975 | Jensen et al. | 339/19 |
| 3,949,457 | 4/1976 | Fortsch | 29/203 MW |
| 4,162,815 | 7/1979 | Fleischhacker | 339/19 |

OTHER PUBLICATIONS

IBM Technical Disclosure Bulletin, vol. 13, No. 8, Jan. 1971, "Connector Assembly".

*Primary Examiner*—John McQuade
*Attorney, Agent, or Firm*—John O. Graybeal

[57] ABSTRACT

Multi-wire group splicing in multi-wire telephone or like distribution systems, utilizing an at least three-sided distribution module (DM), the distribution module (DM) comprising an array of bridging slots (128, 130, 132, 134) in each of its sides (120, 122, 124, 126), and an array of disc type connectors (210 or 230 or 232) for interconnection of the respective prongs (502) of conventional prong type bridging modules (BM or 500) engaging the sides of the distribution module. By use of the distribution module (DM), additional or substitute multi-wire groups can be connected into the distribution system without interruption of service, and field fabrication of splices need involve only the "building" of prong type bridging modules (BM) at the ends of wire group sections of the system, with interconnection of the sections being simply by plugging of the prong type bridging modules (BM) into the distribution module (DM). Double prong type extender coupler means (EC) may also be used in conjunction with an in service distribution module (DM) in some instances, to add additional distribution modules (DM2), and therefore additional bridging module receiving sides to a given splice.

17 Claims, 20 Drawing Figures

DISTRIBUTION MODULE FOR MULTI-WIRE GROUP

TECHNICAL FIELD

The present invention relates to telephone or like multi-wire distribution systems and more particularly to field splicing components utilized in such systems, specifically distribution modules and extender connectors enabling non-destructive splicing of additional or substitute multi-wire groups in such systems.

BACKGROUND ART

Telephone and like multi-wire distribution systems of several types are in widespread use and a wide variety of modules and connectors are known and used for replacement or add-on splicing in such systems. One such type in extensive use is disclosed in Frey et al U.S. Pat. No. 3,772,635, issued Nov. 13, 1973, and assigned to Bell Laboratories Incorporated, Murray Hill, N.J., In which a basic splice unit (hereinafter typically referred to as a Bell type two-wire butt assembly and shown herein at FIG. 11A) is made up in the field of three parts, an index strip, a connector module, and a cap, with one multi-wire group being installed between the index strip and connector module and another multi-wire group to be joined thereto being installed between the connector module and the cap. As also shown and discussed in said U.S. Pat. No. 3,772,635 and in FIG. 11A hereof, the Bell type two-wire butt assembly made up of these parts may have connected thereto an additional multi-wire group terminating in a so-called bridging module (hereinafter typically referred to as a Bell type bridging module). However, because of the nature of the construction of the Bell type two-wire butt assembly and Bell type bridging module, only one bridging module can be added to any given two-wire butt assembly and, if a given installation requirement dictates yet another multi-wire group be added to the assembly or be substituted for one of the wire groups interconnected in the butt assembly, the butt assembly must be destructed in the sense of disconnection of the wire groups from the assembly, which is a time-consuming and costly field effort.

Stackable or pluggable multi-wire modules or connector systems are also known and extensively used in the art, such as disclosed in Enright U.S. Pat. No. 3,708,779, issued Jan. 2, 1973, and assigned to Minnesota Mining and Manufacturing Company (and known in the art as the 3M multi-wire system) and in Fleishhacker U.S. Pat. No. 4,162,815, issued July 31, 1979, and assigned to AMP Incorporated (and known in the art as the AMP type distribution system). Connector components of these other systems (the 3M system and the AMP system) are incompatible with each other and with the Bell type distribution system and its splicing assemblies and connector modules, and are further limited in their ability to plug and unplug any given wire group, i.e. in many instances a changeover from one distribution arrangement to another distribution arrangement must necessarily involve disconnection of service of certain groups in order to make the reconnection or resplice. This is because the so-called stackable or pluggable multi-wire splicing modules or connectors disclosed in said U.S. Pat. Nos. 3,708,779 and 4,162,815 are of two-sided construction, with the consequence that any intermediate module or connector in a stack cannot be easily accessed except by disconnection from at least one adjacent module or connector before reconnection to another. Moreover, from the point of view of those involved in the task of field splicing in these systems, the 3M and AMP plug type modules or connectors are as a practical matter considerably more cumbersome to build in the field and to use than is the Bell type bridging module.

It is a further disadvantage, from the point of view of field splicing operations, that all of these prior splicing systems, the Bell type, the 3M type, and the AMP type, involve the construction or "building" of the splicing module or connector in the field, with but one person working on one splice at a time, which limits the productivity of a splicing crew. This is because the splice usually must be "built" within the confines of a so-called splice case. In contrast, and as more specifically discussed hereinafter, the distribution module of the present invention, which does not involve the installation of the individual wires of the multi-wire group in the distribution module itself in the field, avoids this limitation on splicing crew productivity.

As earlier indicated in general terms, the Bell type two-wire butt assembly offers very little flexibility for adding on or substituting an additional wire group, since its wire groups cannot be "unplugged" except by physical destruction of the assembly. Field practice in this respect involves cutting of the wires from the assembly and discarding the module, with the whole section of wire cable sometimes also being abandoned and replaced by another because there is not sufficient wire length left to install the original wire in another module.

It is also a disadvantage of the AMP type and 3M type distribution system splicing components that the splicing apparatus is inherently relatively complex and relatively difficult to handle in the field, particularly with respect to wire continuity testing. Incorporation of distribution modules according to the present invention, with wire group connections on three or more sides, renders continuity testing relatively simple, which can substantially improve field crew productivity even aside from the relatively simple splicing module construction involved, i.e. bridging modules such as the Bell type bridging module with prong type individual wire connectors are relatively easy to field construct and test.

The distribution module and associated extender connector of the present invention is entirely compatible with the splicing components utilized in the Bell multi-wire distribution splicing systems such as disclosed in U.S. Pat. No. 3,772,635, with which the two-sided pluggable modules used in the AMP and 3M type splicing systems are not compatible. Moreover, the splicing components of the present invention overcome major disadvantages of the Bell type splicing system, wherein add-on is limited to one additional wire group bridging module, and wherein wire group substitution in the two-wire butt assembly can be done only by destruction of the assembly. By use of the present invention, the Bell type splicing system, and other splicing systems as well, are rendered completely pluggable and completely flexible from the point of view of changing the distribution system without component destruction and without circuit interruption.

DISCLOSURE OF THE INVENTION

A significant advantage and feature of the present invention is that it provides a wire group coupling means for interconnection of two or more standardized multi-wire group bridging modules without necessity of any of the wires being physically installed directly in the coupling means.

Further advantages and features of the present invention include the following:

All multi-pair wire groups may be factory pre-assembled on a so-called pre-connectorized basis, with cable ends terminating in standard male type, i.e. prong type bridging modules, which considerably simplifies what is known as the CONECS distribution system, as used extensively throughout the Bell Telephone system, and which at the present time utilizes wire groups pre-assembled with respective male and female module ends for splicing interconnection.

Wire group transfers can be made without destruction of the wires or cable end connector of the disconnected group.

Multiple group splicing, involving more than three-way splices, readily can be made as field assemblies in an existing installation by use of coupling modules according to the present invention.

So-called half taps can be made simply by bridging module connection and disconnection at both ends of a cable section to be replaced.

Distribution modules and extender couplers of the present invention are fully compatible for use with presently standardized Bell type distribution system components.

Field transfers from one wire group to another can be readily made without interruption in service.

Distribution modules of the present invention, while preferably configured to be four-way or four-sided connectors, can readily be made in other multiple connector configurations with more than four sides, or even three sides, if desired, in view of the circular or disc type metal contact element or conductor element employed for each individual wire interconnection.

Field assembly, and the testing of splicing components in the field, are greatly simplified by use of the present invention, as compared with existing practice, because the only field construction or "building" necessary in practice of the invention is of the bridging modules (since two-wire butt assemblies as shown in U.S. Pat. No. 3,772,635 are no longer used) and because continuity testing of the wires in a bridging module may be completed before the bridging module is completely assembled (i.e. before its cap is in place), while the first wire group of a field fabricated two-wire butt assembly must be tested for wire continuity only after the assembly of the wires in the index strip and the connector module, which of course then requires that the components be disassembled (and often damaged) if the testing reveals any unsatisfactory wire connection.

In a typical field splicing assignment involving a two person crew performing multiple in-line splices in a confined work space, the coupler system of the present invention, involving only field fabrication of bridging modules, enables the two person crew to work much more rapidly and efficiently in that each person can independently fabricate and test different bridging modules at the same time, each at a respective side of the work space, and each using his or her own module fabrication tool (as in FIGS. 12A-C in U.S. Pat. No. 3,772,635). This is because the bridging module fabrication can be and is performed on one end of a wire group without the necessity of the end of the wire group to which it is to be connected being physically assembled together in the same module in the tool. This procedure is to be contrasted with existing procedure where one person of a two person crew assembles one wire group into the splicing module and the other person assembles the second wire group into the same splicing module and each must wait until the other person is finished with his or her portion of the assembly before being able to do his or her portion of the assembly.

As indicated, the splicing technique and system of the present invention involves at most the fabrication or "building" in the field of relatively simple bridging modules, which can be tested for continuity before connection of two sections of multi-wire cable together. Because of this, the invention is particularly advantageous from the point of view of providing for field personnel a more practical and reliable way of field testing multi-wire cable installations. Conventional practice in Bell type distribution systems which involve splicing by use of two-wire butt connectors can often find splicers faced with a situation where testing of wire continuity with existing equipment is unreliable because long cable sections render continuity variations attributable to faults so small as to not be sensed by the test equipment. For example, if a 3000 ft. section of cable (a so-called short section) is to be joined by splicing to a 30,000 ft. section of cable (a so-called long section) from the system central office, the prescribed Bell procedure involves first assembling the wires of the central office section of cable into the index strip of a two-wire butt assembly, then applying the connector module to the index strip and testing the 30,000 ft. section for wire continuity. Assuming no fault is found, the wires of the short section are then assembled onto the connector module and the assembly is again tested for continuity, purportedly to reveal any faults in the short section. However, at this point, even if there is a fault in the short section, the fault is likely not be be revealed by the test because what is being tested is the sum total of the long section and the short section so that 9/10th of the test response is from the long section and only 1/10th of the response is from the short section, and if the test equipment has an error factor of $\pm 10\%$ or more, a fault in the short section simply will not be sensed. In contrast, utilization of the present invention involves fabrication of the long section into a bridging module then testing the long section for continuity. In like manner, the wires of the short section are assembled in a bridging module and tested as to continuity before connection to the long section. With the continuity of each section thus separately tested, any fault in the short section is not masked by the long section and therefore much more readily discerned. After both sections and the bridging module ends thereof are separately tested, the two are then simply connected together through a distribution module (which of itself was pretested when made, for example) to complete the splice. Thus, the present invention enables field personnel to always be able to fabricate and test the shorter section in any given splicing situation, which is not always possible when using the conventional Bell splicing components and prescribed technique.

In view of its complete compatibility with the Bell type splicing connectors and system disclosed in U.S. Pat. No. 3,772,635, the present invention retains and in many respects improves upon the advantages of such existing connectors and system, such as:

All types of splicing may be performed with relatively few types of modules and couplers, such as butt, bridge tap, and bridge splicing.

Various types and sizes of wire conductors may be accommodated, i.e. a aluminum and copper conductors in a wide range of gauges.

Built-in encapsulation, such as by use of gels in a known manner, may be employed so that no costly post-assembly encapsulation is necessary.

Multiple additional bridge taps may be subsequently installed without destruction of a splice or the end coupler module of a disconnected group.

BEST MODE OF THE PRESENT INVENTION

Figures 1, 3, 8, 9, 10:
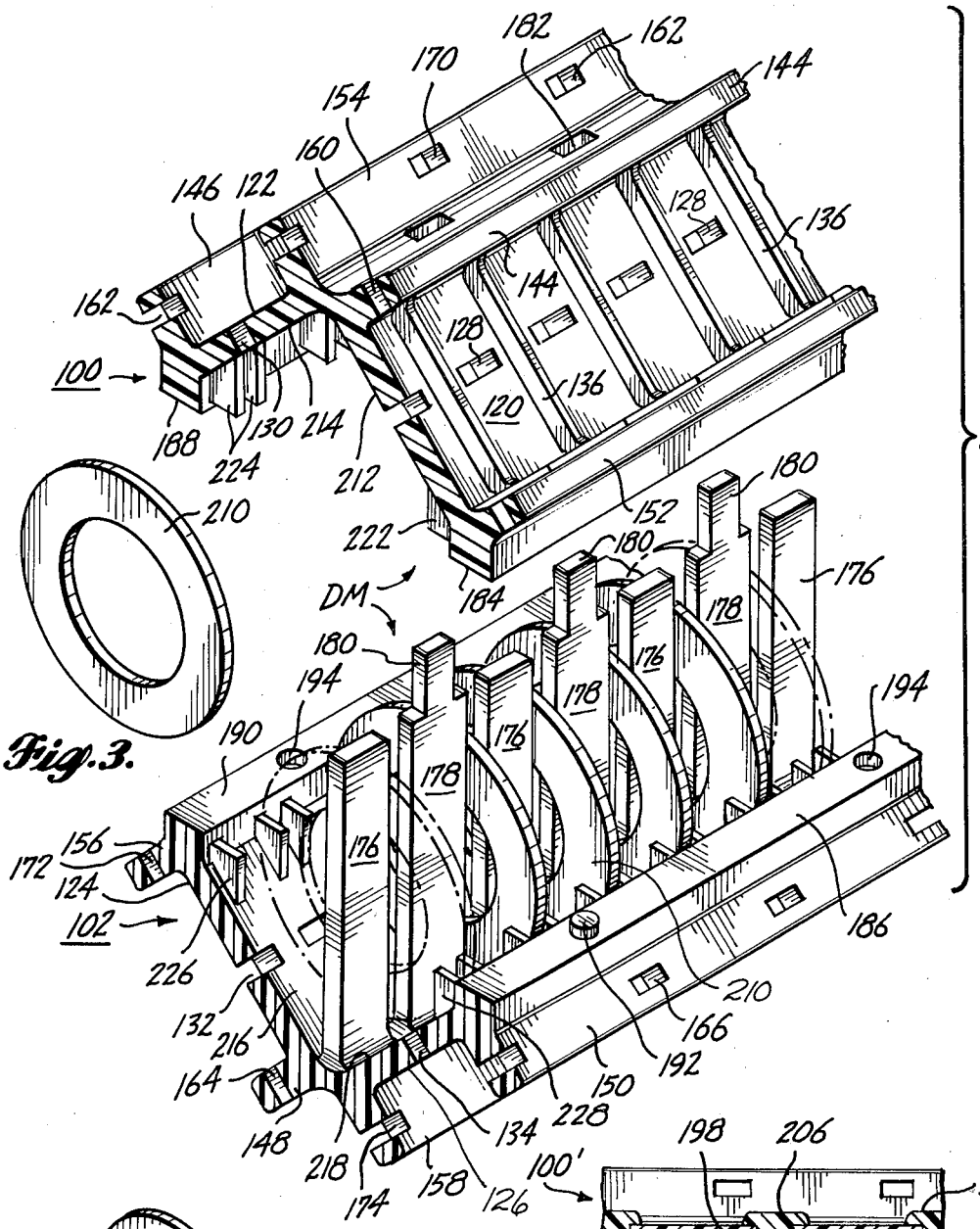
FIG. 1 is an exploded, perspective, fragmentary view of a central section of a distribution module used in the multiple wire pair connector system of the present invention.
FIG. 3 is a detail perspective view showing one of the wire interconnector or individual conductor elements used in the module shown in FIGS. 1 and 2.
FIG. 8 is a partial view in cross section similar to the view of FIG. 6, and showing a modified form of component construction whereby each component is of a form identical to the other.
FIG. 9 is a detailed perspective view of a modified form of a wire interconnector or conductor element.
FIG. 10 is a detailed view of a further modified form of wire interconnector or conductor element usable in a distribution module according to the present invention.
Figure 2:
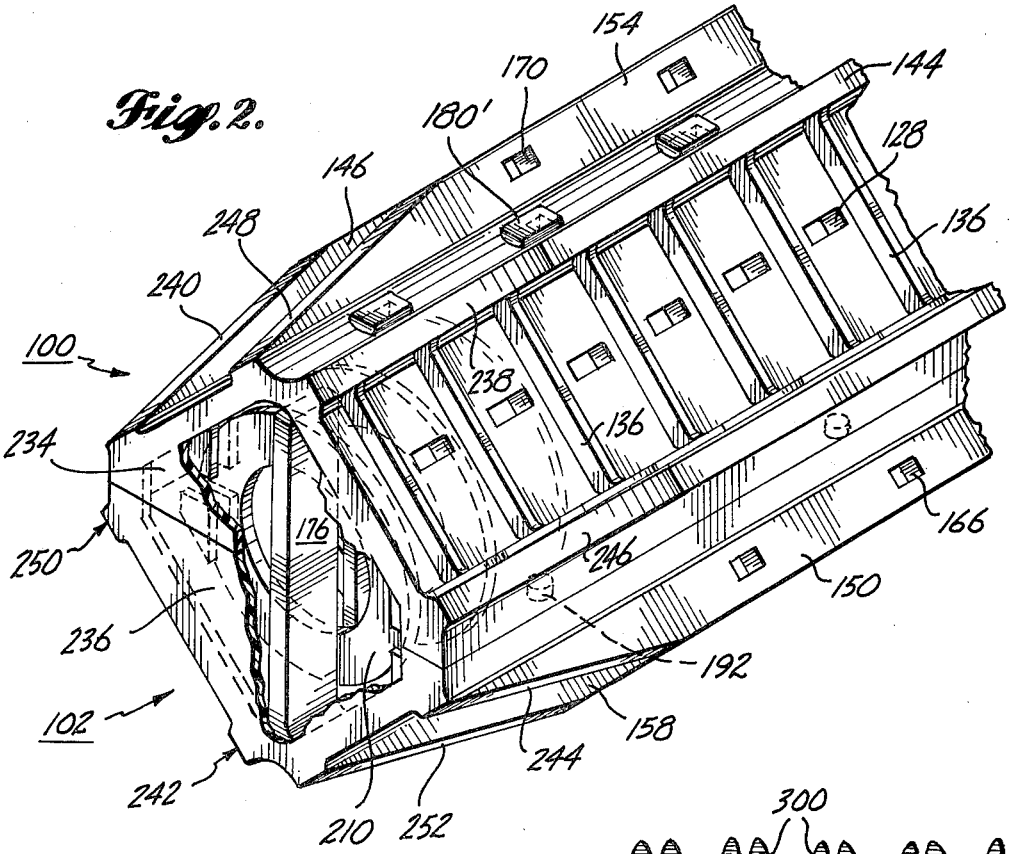
FIG. 2 is a view similar to that of FIG. 1 and in part cut away for clarity, showing the end portion of the distribution module with its parts in assembled relationship.
Figure 5:
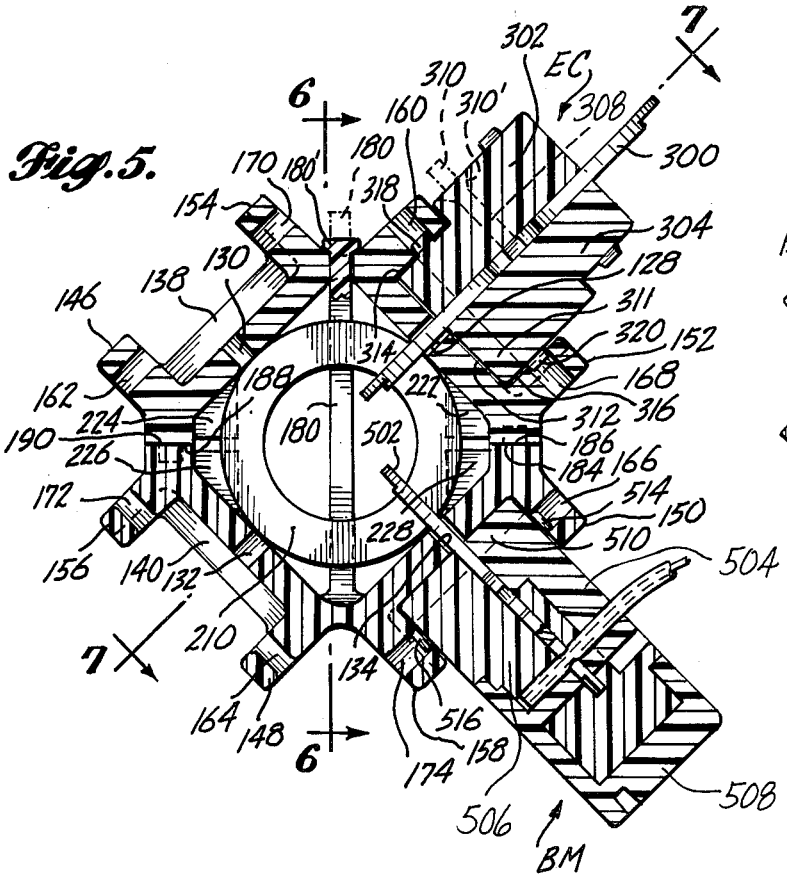
FIG. 5 is a view in lateral cross section and on the same scale as FIGS. 1 and 2 of the distribution module shown in FIGS. 1 and 2 with a double prong extender connector and a bridging module assembled therewith.
Figure 11A:
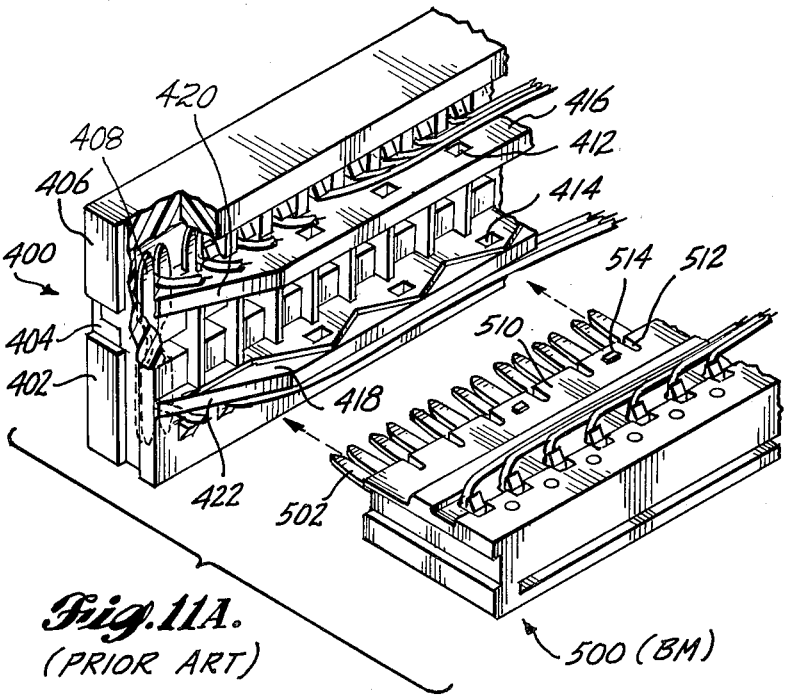
Fig. 11A. (PRIOR ART)
FIG. 11A is a perspective view with various parts broken away for clarity, showing the constructional nature of the prior art, Bell system type of splicing assembly such as disclosed in U.S. Pat. No. 3,772,635.

In its presently preferred form for practice of the present invention, the distribution module DM is shown fragmentarily in FIG. 1 with its upper and lower parts 100, 102 in exploded view, is shown fragmentarily in FIG. 2 with the parts assembled, and is further shown in FIG. 5 in assembly with a double prong extender connector EC according to the present invention as used for interconnecting the distribution modules DM, and also in assembly with a conventional Bell system type bridging module BM (also designated 500 in FIG. 11A).

Viewing the distribution module DM compositely, the preferred form shown is in general four-sided or "quad" in nature, with each respective external sidewall or face 120, 122, 124, 126 substantially perpendicular relative to the adjacent sidewalls or faces. According to the present invention, bridging slots are arranged in in-line rows in each sidewall or face and are arranged in laterally aligned relation relative to corresponding bridging slots in the other sidewalls or faces. Thus, the module DM is provided with a longitudinal row of bridging slots 128 in sidewall 120, a row of bridging slots 130 in sidewall 122, a row of bridging slots 132 in sidewall 124, and a row of bridging slots 134 in sidewall 126, each such row providing access means for interconnection of the distribution module DM to a bridging module BM or as appropriate, an extender connector EC. The sidewalls 120–126 include respectively laterally extending partitions 136, 138, 140, 142 which, along with respective inner rails 144, 146, 148, 150 and outer rails 152, 154, 156, 158, interfit with and surround the pedestal portions 510 (FIG. 11A) around each prong 502 of the bridging module BM. Inner rails 144–150 and outer rails 152–158 are respectively so termed because of the slight offset of the bridging slots 128–134 laterally in the respective sidewall, with each such slot being somewhat nearer the inner rail than the outer rail, which construction is selected simply to render the distribution module DM compatible with existing Bell system type bridging modules, as disclosed in U.S. Pat. No. 3,772,635. Arranged in a manner to be also compatible with such bridging modules BM are respective inner latching holes 160, 162, 164, 166 spaced along the inner rails 144–150, and respective outer latching holes 168, 170, 172, 174 spaced along the outer rails 152–158, which latching holes are engaged by corresponding latching nubs 514, 516 (FIG. 5) on each bridging module BM when the bridging module is in assembled position (as in FIG. 5) engaging a given sidewall or face of the distribution module DM.

Fabrication of the module DM, in the preferred form shown, is facilitated by the molding thereof in two parts, i.e. upper and lower parts 100, 102. As will be readily understood by those in the art, these components are suitably molded from nonconductive plastic of a nature known per se and the parts are configured to interfit and be assembled as a structurally integrated unit by known state of the art techniques. Thus, in this connection, the form of module DM shown in FIG. 1, comprises as part of its lower body half 102 a series of spaced, upstanding pedestals or spikes 176, 178, the alternate pedestals 178 further including heat seal tabs or extensions 180, which, when the parts are assembled together as diagrammatically indicated by arrows 181 in FIG. 4, project through assembly slots or joining holes 182 in the module upper body half 100, the respective heat seal tabs 180 being heat softened and enlarged during fabrication to lock the two body parts together, such softened and enlarged tabs being indicated at 180' in FIGS. 2 and 5, for example.

As will be readily understood, the respective body parts 100, 102 comprise respective interengaging surfaces 184, 186 and 188, 190, and include alternately arranged alignment tips 192 and holes 194 for longitudinal and transverse registry of the parts and shear strength.

As an alternative arrangement for the design and fabrication of the two body parts to form a distribution module according to the present invention, and as shown in FIG. 8, the upper and lower body parts, there designated at 100' and 102', can be formed to each be identical with the other, i.e. with alternating pedestals 196 and joining slots 198 in the upper body half 100' and alternating pedestals 200 and joining slots 202 in the lower body part 102', the respective pedestals 196, 200 being provided with heat seal tabs 204, 206. Since each of the parts 100', 102' is identical to the other, they can be formed in a single mold or like molds, if desired.

Figure 6:
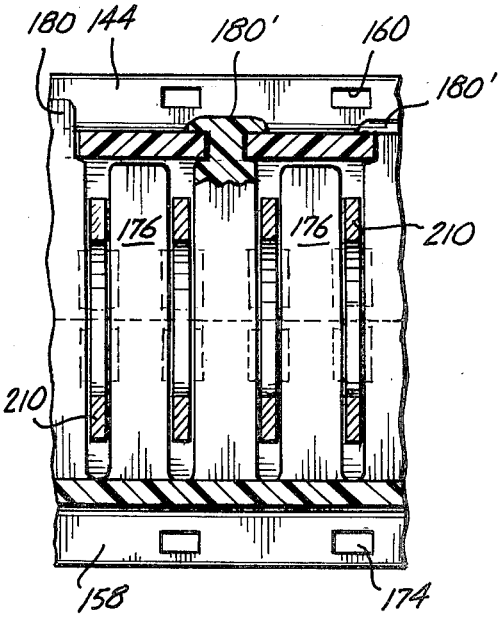
FIG. 6 is a partial view in longitudinal cross section of the distribution module as shown in FIG. 5, taken substantially along line 6—6 thereof.

It is a unique feature and advantage of the present invention that several prong type multi-wire bridging modules, such as shown in U.S. Pat. No. 3,772,635, can be interconnected or spliced together without destruction of the components of an existing splice. This is accomplished by reason of the unique structure of the distribution module of the present invention, which provides within the module body a disc type conductor for each bridging module prong input, the configuration and orientation of each such conductor being such that several other connector prongs can be engaged therewith radially. To this end, the distribution module of the present invention, as shown in FIGS. 1–5, comprises a parallel coaxial array of conductor discs 210, each centered about the longitudinal axis of symmetry extending longitudinally and axially of the module DM, and each placed to be in aligned relationship with a corresponding set of laterally aligned bridging slots 128–134. Such conductor discs 210, suitably in the form of rings as shown in FIGS. 1–5, are readily fabricated of conductive sheet metal of a type known per se in the art and of suitable thickness, such as 0.020 inch thick tin plated cartridge brass plate, and in the assembly module each is held in relatively fixed position by contact with the inner walls 212, 214, 216, 218 and with positioning tabs or fins respectively standing inwardly from the inner walls, such tabs being respectively designated at 222, 224, 226, 228 (also note FIGS. 6 and 7 in this connection). As will be evident from FIGS. 5 and 7, the prongs 502 of a bridging module BM and the prongs 300 of an extender connector EC, upon insertion through a given row of bridging slots, frictionally engage the conductor disc 210 and each disc completes the electrical circuit between a respective prong 502 and respective prong 300, for example.

FIG. 9 shows a modified form of disc type conductor 230, wherein the conductor is generally circular but solid edge to edge. As will be apparent, this conductor can be used interchangeably with conductor 210 and its use is largely a matter of choice.

FIG. 10 shows a further modified form of disc type conductor 232 usable as the bridging prong interconnection means in a distribution module DM according to the present invention. In this form of disc type conductor, the configuration is generally square and can be readily accommodated in the distribution module DM without modification in that the space to be occupied by the conductor is of a generally square configuration.

FIG. 2 is a perspective view of one end portion of the distribution module DM with the parts in assembled relation and with certain parts partially cut away for clarity. As will be observed in FIG. 2, the construction of the body parts 100, 102 include respective closed end panels 234, 236 which, along with like end panels (not shown) at the other end of the module, serve to enclose the interior space of the module so that the only openings therein for practical purposes are the various bridging prong receiving slots 128, 130, 132, 134, such enclosure of the module interior space enabling use if desired, in a manner conventional per se, of a nonconductive gel or the like interiorly of the module for insulation and erosion protection purposes.

As also shown in FIG. 2, the end configuration of the various inner rails 144-150 and outer rails 152-158 terminate in respective sloped portions or ramps 238, 240, 242, 244 and 246, 248, 250, 252 in the same manner as sloped portions 420, 422 are provided on the rails 416, 418 or the Bell type two-wire butt assembly (FIG. 11A). These sloped portions at the ends of the rails of the distribution module DM of the present invention serve the same purpose as the sloped portions of the rails of the Bell type two-wire butt assembly, which is that they are engageable by a wedge type tool, conventionally used by field splicing crews working with Bell type splicing systems, such as Bell Bridge Removal Tool No. AT 8745, which by prying action against the rail sloped portions, disengages the bridging module BM from the butt assembly or the distribution module DM, as the case may be, the sloped portions serving as ramps against which the tool works to move the bridging module away from the rails.

Figure 7:
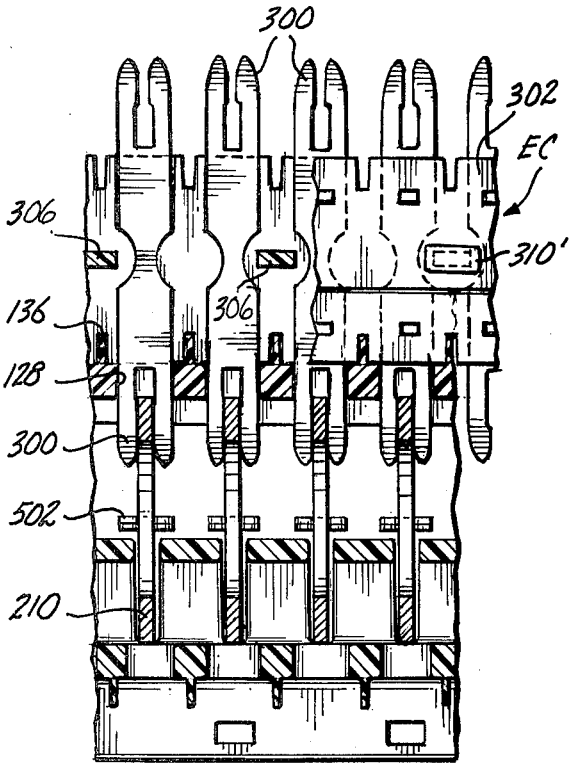
FIG. 7 is a further partial view in cross section of the distribution module and double prong extender coupler shown in FIG. 5, taken substantially along line 7—7 thereof.
Figure 4:
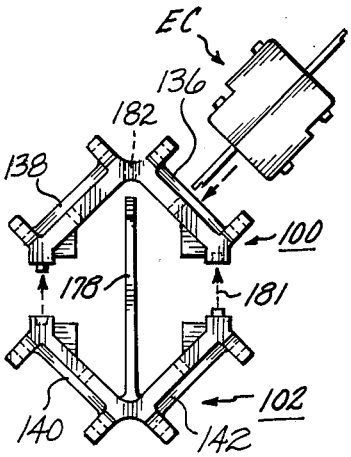
FIG. 4 is a somewhat diagrammatic view on a reduced scale, illustrating the manner of assembly of the module components of the distribution module shown in FIGS. 1 and 2, and further showing the manner of assembly therewith of a double pronged extender coupler as used to interconnect plural distribution modules and further increase the number of bridging module interconnection faces in a given field installation utilizing the present invention.

As will be discussed in more detail in connection with FIGS. 12 through 15C, the distribution modules DM of the present invention can be used either singularly or several can be used as desired or necessary in a given splicing situation, which flexibility in use is accomplished by a readily prefabricated extender connector EC, as shown in FIGS. 4, 5 and 7. The extender connector EC comprises a side-by-side, longitudinally aligned array of double prong connectors 300, also suitably fabricated of 0.020 in. thick tin plate cartridge brass plate, for example, and of a type known in the art as spring compression reserve prongs. The double ended prong conductors 300 are assembled in fixed array between upper and lower body parts 302, 304 of molded nonconductive plastic construction, utilizing an assembly procedure involving pedestal, joining slot and heat seal tab components, in a manner known per se. Thus, in the form shown in FIGS. 4, 5 and 7, the extender connector EC comprises pedestals or spikes 306 on lower part 304, each of which interfits within a slot 308 in body part 302 and each of which has a heat seal tab 310 which, when flattened and enlarged as indicated at 310', provides an integral assembly of the parts.

The extender connector EC is configured on its external surfaces to assemble and lockably engage with any given external face of the distribution module DM and in such respect is externally configured like and has the appearance of a bridging module BM insofar as the surfaces thereof which interengage the distribution module DM. Thus, the extender connector EC comprises in the pedestal area 311 around each of its prongs 300 an external surface 312 which engages any given sidewall 120–126 and is also provided with sidewalls 314, 316, and latching nubs 318, 320 which contact any respective inner rail and outer rail and associated latching holes, such as inner rail 144, outer rail 152 and latching holes 160, 168, for example. As will also be understood, the outer surfaces of the extender connector EC, as shown in FIG. 5 for example, are reversely identical to the surfaces there shown as engaged with the distribution module DM, the connector being reversible side for opposite side from the position shown in FIG. 5.

Figure 11B:
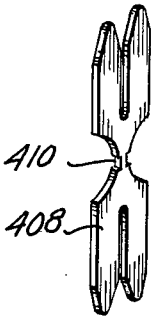
Fig. 11B. (PRIOR ART)
FIG. 11B shows in enlarged detail the configuration of one of the prong type wire interconnecting conductor elements thereof.

FIG. 11A shows in exploded, perspective view, with certain parts broken away, a so-called Bell type two-wire butt assembly, with associated bridging module, which are characteristic of the conventional Bell system splicing arrangement and technique disclosed in U.S. Pat. No. 3,772,635. FIG. 11B is a detail view on an enlarged scale of an individual prong type conductor as employed in such a two-wire butt assembly. Reference should be had to said prior U.S. Pat. No. 3,772,635 for a more detailed description of this assembly and bridging module. However, for purposes of this disclosure, it will be understood that the Bell type two-wire butt assembly, generally indicated at 400, involves an index strip 402, a connector module 404 and a cap 406, the connector module 404 including an aligned array of double ended slotted contact elements indicated at 408 and shown in enlarged detail in FIG. 11B. Field fabrication of this assembly involves laying of the individual wire pairs of one wire group into the index strip 402, with the connector module 404 then being snap mounted onto the index strip, the slotted contact elements 408 penetrating the insulation and each making contact with each laid wire in the process. Fabrication of the butt assembly is performed in the field with a tool such as that disclosed in the aforesaid U.S. Pat. No. 3,772,635 (at FIGS. 12A, 12B and 12C thereof). After the first wire group is clamped in the index strip 402 by the connector module 404, the second wire group is laid onto the slots of the contact elements standing upwardly from the connector module 404 and the cap element 406 is snap mounted onto the connector module 404 by means of the same tool. With this arrangement, any disassembly of the splice amounts to a destruction of the two-wire butt assembly and, possibly more importantly, the only points of connection for the prongs of a bridging module BM (also designated 500 in FIG. 11A) are the narrow necked portions 410 (FIG. 11B) of the slotted contact elements 408 at one side of the two-wire butt assembly. Such a splicing assembly is therefore inherently limited to connection of only one bridging module, and must be destructed in order to introduce any additional splicing into the system.

As also disclosed in the aforesaid '635 patent, the Bell type bridging module or bridge connector as designated at BM and 500 in FIGS. 5 and 11A, comprises an aligned array of prong conductors 502 with two body parts 504, 506 and a cap 508. Each of the conductor prongs 502 emerges from a pedestal portion 510 ith intervening slots 502 and sidewardly extending nubs 514, 516, which interengage with respective latching holes 412, 414 in the rails 416, 418 of the two wire butt assembly 400.

As shown in FIG. 5, the bridging module BM is connectible without modification to the distribution module DM of the present invention and, by use of such distribution module DM, can be directly interconnected with one or more other bridging modules which is not a capability of the two-wire butt assembly 400 of the Bell splicing system. FIGS. 12 through 15C further schematically illustrate the operational advantages of the present invention in this respect.

Figure 12:
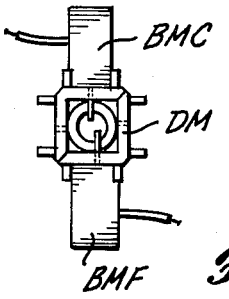
FIG. 12 is a schematic view of the interconnection arrangement wherein the distribution module of the present invention is utilized to make up a so-called two-way or straight splice along with bridging module terminated wire groups, one being a so-called central office or feed group and the other being a field distribution group.

In FIG. 12, a distribution module DM of the present invention is shown as used in forming a so-called straight or two-wire group splice. In FIG. 12 the central office (CO) group, terminating in a conventional bridging module BMC, is plugged into one side of the distribution module DM and the field distribution group bridging module BMF is plugged into another, usually opposite, side of the module DM. As will be noted, in this arrangement, two additional sides of the distribution module are open or blank for possible later connection of additional bridging modules or extender couplers.

Figure 13:
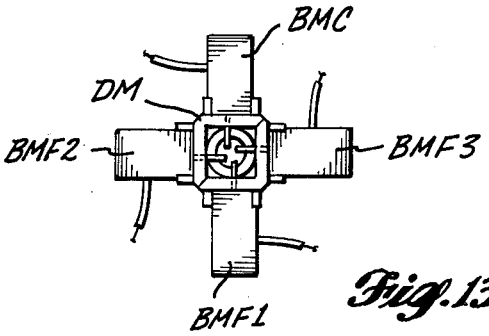
FIG. 13 is a schematic view similar to that of FIG. 12, showing use of the distribution module of the present invention to interconnect a central office or like wire group with three field distribution wire groups.

In FIG. 13, the distribution module DM of the present invention is shown forming a four-way splice with the incoming group from the central office terminating in bridging module BMC, and field distribution groups BMF1, BMF2 and BMF3 connected into the other three sides of the module.

While a four-way distribution module DM has the capability of having all four sides thereof connected to bridging modules, as shown in FIG. 13, it is preferred practice to install bridging modules at only three sides thereof, leaving one side open for receiving an extender connector EC, and in turn another distribution module DM added to the connector EC, at such time as one or more further wire groups are to be added to or substituted into the splice. By this procedure, leaving one side of the distribution module open or blank during normal operation, it is not necessary to disconnect from service any given wire group before its replacement group or before an additional group is connected in service, as the case may be.

Figure 14A:
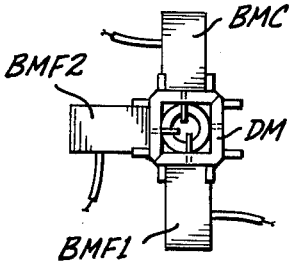
FIGS. 14A, 14B and 14C schematically illustrate the manner in which distribution modules of the present invention are assembled with double prong extender coupler means to expand the number of bridging module connector faces in a given installation.
Figure 14B:
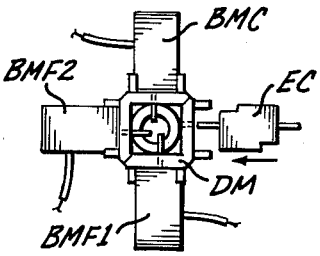
Figure 14C:
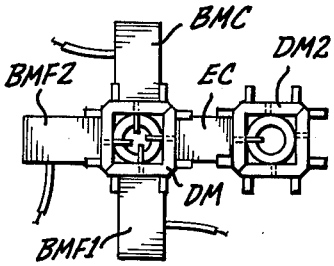

FIGS. 14A, 14B, and 14C illustrate the manner in which a quad coupler according to the present invention is usable to expand field distribution in a manner permitting an indefinite additional number of splices, that is permitting an indefinite number of field distribution groups to be connected to a single central office group, for example. Thus, in FIG. 14A, presuming an existing installation has two field distribution groups connected to a central office group, if several additional field distribution groups are to be added onto this installation, the originally blank side of the module DM has installed therein a double prong extender coupler EC of the present invention (FIGS. 4, 5 and 7) and a second distribution module, designated DM2 in FIG. 14C, is in turn installed on the other side of the coupler EC which makes available the three additional blank sides of the second module DM2 for connection of field distribution bridging modules thereto. As will be apparent, if still further field distribution groups are to be connected, a further double prong coupler or couplers and a further distribution module or modules may be added, as desired.

Figure 15A:
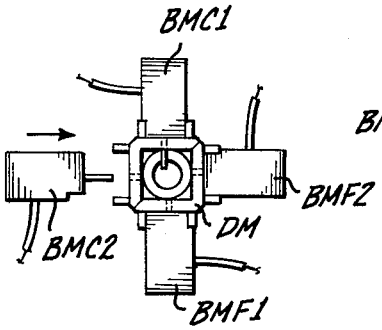
FIG. 15A, 15B and 15C collectively schematically illustrate the manner of transferring field distribution groups from connection with an old central office group to connection with a replacement central office wire group without interruption of service to the field distribution groups.
Figure 15B:
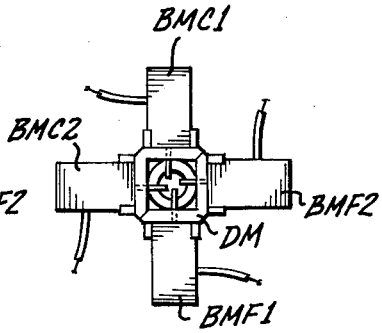
Figure 15C:
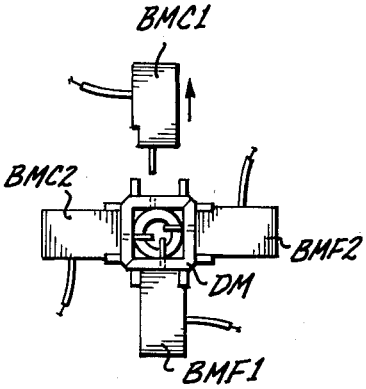

A common field problem in servicing telephone distribution systems is that of having to transfer at a given splice from an existing central office wire group to a new central office wire group. With previous splicing modules it is necessary (unless a time-consuming process known as cut and close is followed) to disconnect the service for a substantial time in order to effect such a transfer. It is an important advantage of the splicing system of the present invention that it makes possible easy and rapid transfer from one central office feed group to another. The procedure for this, using the distribution module DM coupler of the present invention, is schematically illustrated at FIGS. 15A, 15B and 15C. In FIG. 15A, the existing installation before the transfer is assumed to involve the existing or old central office feed group terminating in a bridging module BMC1 with two field distribution bridging modules BMF1 and BMF2 connected thereto and with one side of the module DM blank, i.e. unconnected. To effect the transfer, the new central office feed group, terminating in bridging module BMC2, is first tested for continuity with the old group, in a manner known pr se, then installed at the blank side of the module DM prior to removal of the old central office feed group module BMC1. By this procedure, the new feed group is placed in service without interference with the existing service and the old feed group can be disconnected (FIG. 15C) without any interruption of the service. It is important also that, by this procedure, the old feed group and its bridging module termination BMC1 are not damaged in the course of their disconnection. This is a significant improvement over existing Bell system procedure where the old central office feed group module BMC1 is simply cut away at the splice and the wire group sometimes must be abandoned due to shortness. As indicated, this transfer procedure is shown schematically in FIGS. 15A, 15B and 15C, FIG. 15A showing the condition of the splice prior to connection of the new feed group, FIG. 15B, showing both the new feed group and the old feed group connected to the distribution module and in service, and FIG. 15C showing the old central office feed group disconnected with the new feed group connected and in service.

As will be apparent, since the bridging module BM and the extender connector EC are respectively identical insofar as the external configuration of the bridging prongs and the external surfaces thereof engaging a given side of the distribution module DM, the extender coupler EC of the present invention is readily connectible directly into a Bell type two-wire butt assembly such as shown in U.S. Pat. No. 3,772,635, and at FIG. 11A, and the distribution module DM of the present invention can then be added to an extender connector thus installed in the two-wire butt assembly. This procedure permits installation of further wire group bridging modules or extender connectors and distribution modules to the splicing components, as desired, i.e. affords complete flexibility in terms of tapping other wire groups into the two-wire butt assembly without disassembly or destruction of the butt assembly.

From the foregoing, it will be apparent to those skilled in the art to which the invention is addressed that distribution modules and extender couplers according to the present invention may be appropriately modified to be used with any multi-wire group splicing components wherein multi-wire groups terminate in modules, other than the Bell type bridging modules, which also have or include individual wire connector prongs in fixed array. Thus, in any multi-wire distribution system wherein two or more wire cable sections to be spliced together terminate in or can be terminated in modules which are of the plug type, or which include a connector prong for each individual wire of a wire group, can interconnect the section end modules by means of a distribution module according to the present invention, i.e. by a distribution module having at least three side faces each with an array of prong receiving slots matching the array of group section terminating prongs. Accordingly, by way of further example, distribution modules (and also extender couplers) characteristic of the present invention, can be used to interconnect several multi-wire group section terminating modules of the AMP type, such as the AMP type connector bodies 6 disclosed in U.S. Pat. No. 4,162,815, the individual wire conductor terminals or prongs 98 of which are comparable to the prongs 502 of Bell type bridging modules.

Various further modifications and adaptations, and characteristic advantages of the present invention will be apparent to those skilled in the art to which the invention is addressed, within the scope of protection afforded by the following claims.

What is claimed is:

1. A multi-wire distribution module for use in field splicing in a multi-wire telephone or like distribution system, said distribution module comprising:

an elongate insulative body, a series of electrical conductor elements of generally disc-like form arranged generally parallel to each other and coaxially of said body, and bridging prong receiving slots arranged in the side faces of said body and in sets radially around each conductor element and in several rows longitudinally of said body.

2. A distribution module according to claim 1, comprising four rows of slots arranged in body side faces with each side face arranged generally perpendicularly of the adjacent faces of the body.

3. A multi-wire distribution module for use in field splicing and the like in a multi-wire telephone or like distribution system, said distribution module comprising:

an elongate insulative body with at least three longitudinally extending external side faces;

prong receiving bridging slots arranged in said body in longitudinal array in the at least three side faces of said body, and with one bridging slot in each side face laterally aligned with a corresponding bridging slot in each other side face of said body;

disc type conductors in substantially coaxial array longitudinally within said body, each such disc type conductor being in aligned relationship with a corresponding set of laterally aligned bridging slots and each conductor electrically interconnecting bridging prongs inserted in any of such laterally aligned set of bridging slots.

4. A distribution module according to claim 3, wherein said disc type conductors are of generally circular form.

5. A distribution module according to claim 3, wherein said disc type conductors are of ring form.

6. A distribution module according to claim 3, wherein said disc type conductors are solid and of uniform thickness edge to edge.

7. A distribution module according to claim 3, wherein said disc type conductors are of generally rectangular form.

8. A distribution module according to claim 3, wherein each side face of the module body comprises parallel side rails with latching holes engageable with corresponding latching nubs on the sides of a bridging module or extender coupler associated therewith.

9. A distribution module according to claim 3 or claim 8, wherein said disc type conductors engage inner walls of said body, with inwardly projecting tabs standing inwardly from said inner walls and positioned to retain said disc type conductors in substantially equispaced, substantially parallel array.

10. A distribution module according to claim 9, wherein each side face of the module body comprises parallel side rails with sloping surfaces at the ends thereof enabling disengagement of a bridging module or extender coupler from the distribution module by means of a prying action applied therebetween, as by means of a conventional disengagement tool of the wedging type.

11. A distribution module according to claim 3, wherein the module body comprises two generally similar elongate body parts, assembled together by means of interengaged pedestals, joining holes, and heat seal tabs.

12. A distribution module according to claim 11, wherein each said body half is identical to the other.

13. A distribution module according to claim 11, wherein pedestals and disc type conductors are arranged alternately longitudinally of the body.

14. A distribution module according to claim 3, wherein the module body comprises two generally similar body halves, each with two side faces, the respective body halves including interengaged end panels, the said body being of essentially completely enclosed form except for the rows of bridging slots.

15. A distribution module according to claim 3 or claim 14, wherein the interior of said body is substantially filled with non-conductive gel.

16. For use in a multi-wire telephone or like distribution system for field splicing or the like, a distribution module for interconnecting bridging modules each of the type having an aligned series of bridging prongs each connected to a wire input, said distribution modules comprising an elongate insulative body with at least three external side faces, each with a longitudinally aligned series of bridging slots configured to receive the bridging prongs of a multi-wire bridging module, each bridging slot in the various module faces being laterally aligned with a corresponding bridging slots in the other external faces, and said distribution module further comrising an array of conductive discs arranged axially longitudinally of the module and each coplanar with a respective series of bridging slots, each such disc being engageable for completing the electrical circuit among bridging prongs inserted in the bridging slots laterally coplanar therewith.

17. In combination with several distribution modules according to claim 16, a double prong connector comprising an elongate insulative body with two, oppositely facing opposed rows of prongs with laterally opposed prongs each electrically interconnected to the other, such insulative body and rows of prongs being configured to be assembled with two distribution modules, in contact with one face of each module, and electrically interconnect the array of conductive discs of each module, each to another in laterally coplanar relationship.

* * * * *